US010541069B2

(12) United States Patent
Yun

(10) Patent No.: US 10,541,069 B2
(45) Date of Patent: Jan. 21, 2020

(54) CHIP RESISTOR AND PASTE FOR FORMING RESIST LAYER OF CHIP RESISTOR

(71) Applicant: Samsung Electro-Mechanics Co., Ltd., Suwon-si (KR)

(72) Inventor: Jang-Seok Yun, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 16/193,608

(22) Filed: Nov. 16, 2018

(65) Prior Publication Data

US 2019/0164672 A1 May 30, 2019

(30) Foreign Application Priority Data

Nov. 28, 2017 (KR) ..... 10-2017-0160854

(51) Int. Cl.

| | |
|---|---|
| ***H01C 7/00*** | (2006.01) |
| ***H01C 1/14*** | (2006.01) |
| ***H01C 17/065*** | (2006.01) |
| ***H01B 1/02*** | (2006.01) |
| ***H01C 1/034*** | (2006.01) |
| *C22C 9/00* | (2006.01) |

(52) U.S. Cl.

CPC ..... *H01C 7/003* (2013.01); *H01B 1/026* (2013.01); *H01C 1/034* (2013.01); *H01C 1/14* (2013.01); *H01C 17/06526* (2013.01); *C22C 9/00* (2013.01)

(58) Field of Classification Search

CPC .... H01C 1/14; H01C 17/06526; H01C 17/24; H01C 10/16; H01B 1/026; C22C 9/00

See application file for complete search history.

(56) References Cited

U.S. PATENT DOCUMENTS

| | | | | |
|---|---|---|---|---|
| 2004/0061096 | A1* | 4/2004 | Urano | H01B 1/22 252/500 |
| 2010/0060409 | A1* | 3/2010 | Smith | H01C 1/142 338/262 |
| 2011/0089025 | A1* | 4/2011 | Yang | C23C 14/185 204/192.21 |
| 2015/0283616 | A1* | 10/2015 | Maekawa | B22F 1/0014 75/370 |
| 2016/0143145 | A1* | 5/2016 | Inaba | H05K 3/3442 174/255 |
| 2016/0240291 | A1* | 8/2016 | Tanaka | H01C 7/20 |
| 2017/0179217 | A1* | 6/2017 | Han | H01L 28/20 |
| 2017/0202089 | A1* | 7/2017 | Yun | H01C 7/18 |

* cited by examiner

*Primary Examiner* — Kyung S Lee
(74) *Attorney, Agent, or Firm* — NSIP Law

(57) ABSTRACT

A paste for forming a resist layer of a resistor includes: a copper-based alloy powder; and nickel (Ni) powder in an amount greater than 0 wt % of the copper-based alloy powder and less than or equal to 10 wt % of the copper-based alloy powder, wherein the paste is glass-free.

15 Claims, 7 Drawing Sheets

CHIP RESISTOR AND PASTE FOR FORMING RESIST LAYER OF CHIP RESISTOR

CROSS-REFERENCE TO RELATED APPLICATIONS

This application claims the benefit under 35 USC 119(a) of Korean Patent Application No. 10-2017-0160854, filed on Nov. 28, 2017 in the Korean Intellectual Property Office, the entire disclosure of which is incorporated herein by reference for all purposes.

BACKGROUND

1. Field

The following description relates to a chip resistor and paste for forming a resistor layer of the chip resistor.

2. Description of Related Art

Chip-shaped resistors, or chip resistors, have been used more frequently, as functions of electronic devices have increased. For example, chip resistors are used as battery indicators or to prevent overcharging of batteries.

For an accurate detection of current, the resist layer of the chip resistor requires a low resistance and a low temperature coefficient of resistance (TCR).

A paste for forming the resist layer of a conventional chip resistor contains alloy that is very sensitive to an oxidizing atmosphere, and thus adhesiveness to a substrate often becomes issue.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a paste for forming a resist layer of a resistor includes: a copper-based alloy powder; and nickel (Ni) powder in an amount greater than 0 wt % of the copper-based alloy powder and less than or equal to 10 wt % of the copper-based alloy powder, wherein the paste is glass-free.

The copper-based alloy powder may include copper-manganese-tin (Cu—Mn—Sn).

A diameter of particles of the nickel (Ni) powder may be less than or equal to 300 nm.

A diameter of particles of the nickel (Ni) powder may be about 180 nm.

In another general aspect, a chip resistor includes: a substrate; a first electrode disposed on a surface of the substrate; a second electrode disposed on the surface of the substrate such that the second electrode is separated from the first electrode; a resist layer disposed on the surface of the substrate so as to connect the first electrode and the second electrode to each other; and a protective layer disposed on a surface of the resist layer so as to protect the resist layer, wherein the resist layer includes a copper-based alloy, and nickel (Ni) in an amount greater than 0 wt % of the copper-based alloy and less than or equal to 10 wt % of the copper-based alloy, and wherein the resist layer is glass-free.

The copper-based alloy may include copper-manganese-tin (Cu—Mn—Sn).

The protective layer may include a first protective layer disposed on the surface of the resist layer, and a second protective layer formed on a surface of the first protective layer.

The resist layer may include a groove.

The groove may be L-shaped.

The chip resistor may further include upper surface electrodes formed, respectively, on the first electrode and the second electrode.

The upper surface electrodes may each include an interpose part interposed between the first electrode or the second electrode and the resist layer, and an extension part extended from the interpose part to a portion of the surface of the resist layer.

The protective layer may include a first protective layer disposed on the surface of the resist layer and on the extension part, and a second protective layer formed on the first protective layer.

The protective layer may extend onto the first electrode and the second electrode.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
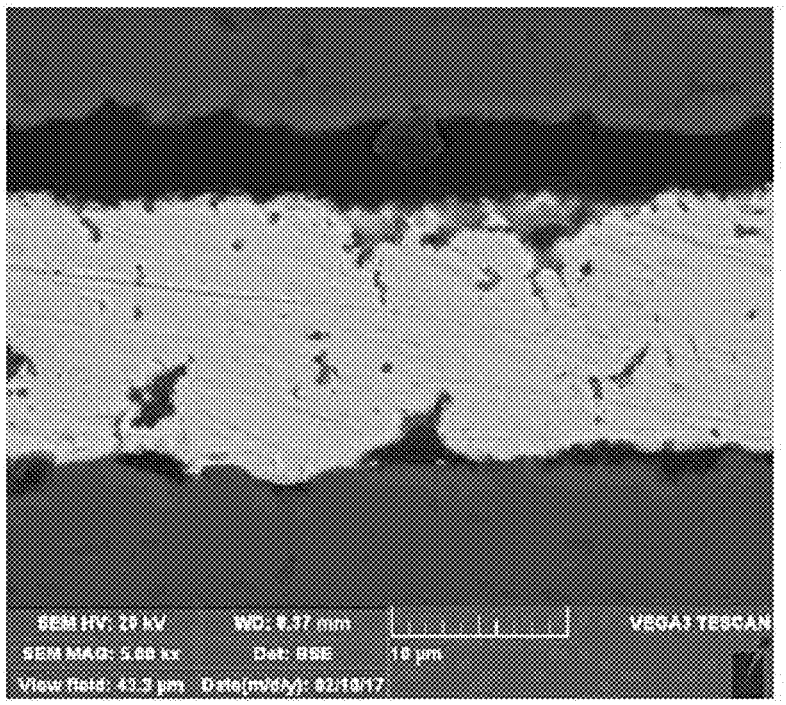
FIGS. 1A to 1D illustrate interfaces between a resist layer (e.g., for a chip resistor) and a substrate, according to a weight percentage (wt %) of nickel included in a paste for forming the resist layer, according to an embodiment of the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Unless otherwise defined, all terms, including technical terms and scientific terms, used herein have the same meaning as how they are generally understood by those of ordinary skill in the art to which the present disclosure pertains. Any term that is defined in a general dictionary shall be construed to have the same meaning in the context of the relevant art, and, unless otherwise defined explicitly, shall not be interpreted to have an idealistic or excessively formalistic meaning.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Hereinafter, example embodiments will be described in detail with reference to the accompanying drawings.

Paste for Forming Resist Layer of Chip Resistor

A paste for forming a resist layer of a chip resistor, according to an embodiment, contains a copper-based alloy powder and a nickel powder, but does not contain glass.

In this description, the copper-based alloy is an alloy having copper contained in the composition thereof. The paste containing the copper-based alloy may be referred to hereinafter as a "copper-based alloy paste."

The copper-based alloy may include copper-manganese-tin (Cu—Mn—Sn). That is, the copper-based alloy may be Zeranin. Alternatively, the copper-based alloy may include copper-manganese-nickel (Cu—Mn—Ni). That is, the copper-based alloy may be Manganin.

In a conventional chip resistor, it is common that a paste for forming a primary resist layer containing glass and paste for forming a secondary resist layer containing no glass are disposed in parallel to form a resist layer, in order to provide a sufficient adhesive force between a substrate and the resist layer. That is, the primary resist layer is disposed on an upper surface of the substrate, and the secondary resist layer is disposed on an upper surface of the primary resist layer.

Specifically, since the copper-based alloy, which is the electrically conductive component of the paste for forming the resist layer, is very sensitive to the oxidizing atmosphere, it is desirable that the paste for forming the resist layer is handled under a strongest possible reducing atmosphere. As glass, which is an inorganic adhesive, loses its fluidity when sintered in a reducing atmosphere, the paste for forming a primary resist layer and the paste for forming a secondary resist layer are commonly used in parallel. As a result, the resist layer of a common chip resistor is formed to include a primary resist layer formed by the paste for forming the primary resist layer and a second resist layer formed by the paste for forming a secondary resist layer.

Therefore, an overall thickness of the resist layer is increased, and the processes for forming the chip resistor become complicated.

By forming the resist layer of a chip resistor from the copper-based alloy paste according to the disclosed embodiments, it is possible to provide a sufficient adhesive force between the substrate and the resist layer even though the paste does not contain glass. Therefore, the overall thickness of the resist layer may be decreased, and the processes for forming the chip resistor may become simpler.

According to an example, an amount of added nickel (Ni) powder in the copper-based alloy paste (e.g., an amount of nickel (Ni) provided in addition to any nickel (Ni) of the copper-based alloy itself) is greater than 0 wt % and less than or equal to 10 wt % of the copper-based alloy. The diameter of particles of the nickel (Ni) powder is less than or equal to 300 nm, for example. According to an example, the copper-based alloy paste may include, in addition to the copper-based alloy and the added nickel (Ni), organic components such as resin, solvent, and dispersant.

Figure 1B:
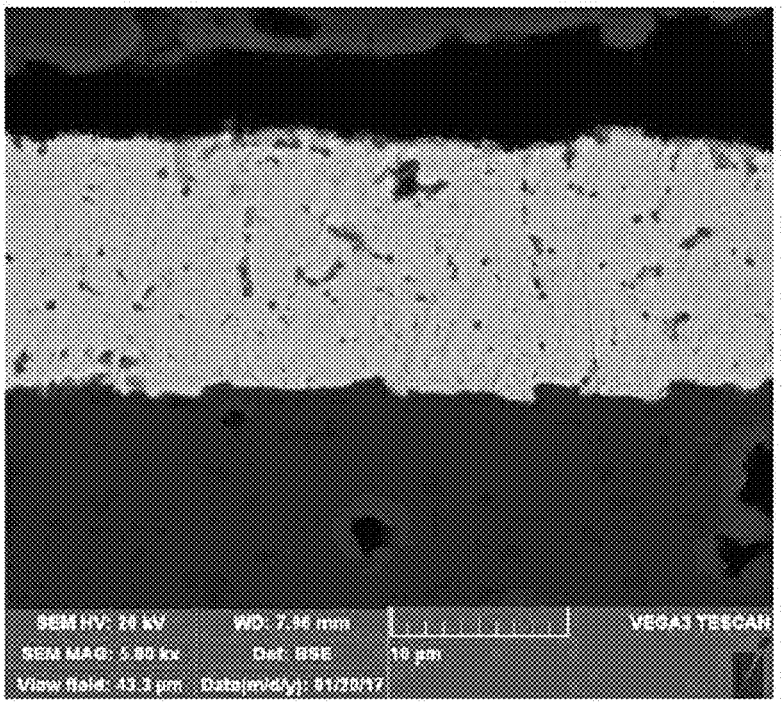
Figure 1C:
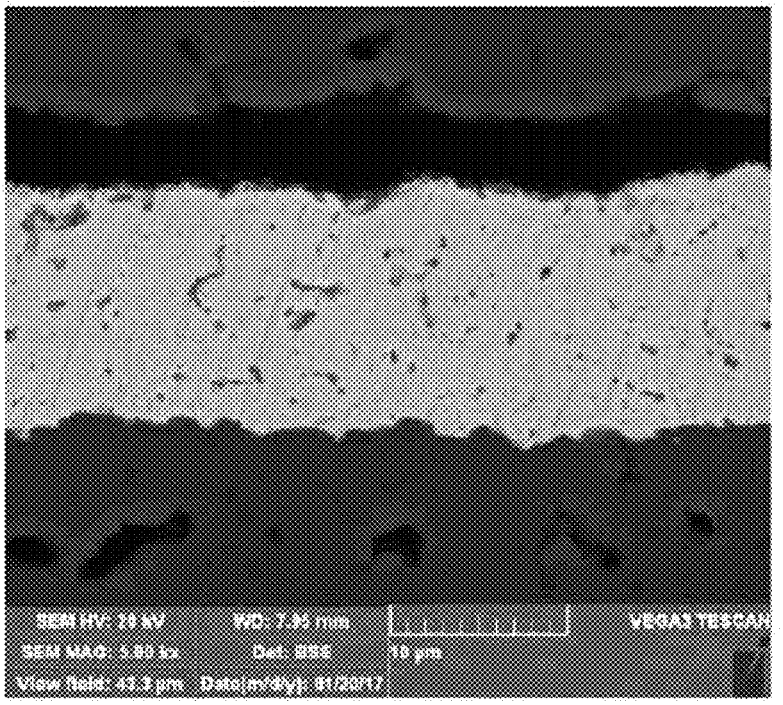
Figure 1D:
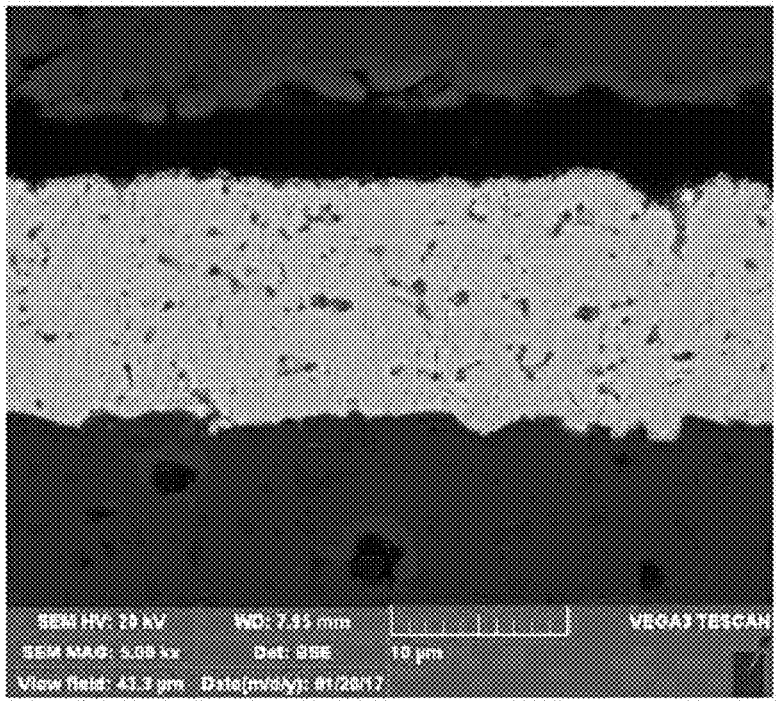

FIGS. 1A to 1D illustrates interfaces between a resist layer and a substrate according to a weight percentage (wt %) of nickel contained in a paste for forming the resist layer. FIG. 1A illustrates an example in which the copper-based alloy paste does not include nickel (Ni). FIG. 1B illustrates an example in which the copper-based alloy paste includes Ni in an amount of 3 wt % of the copper-based alloy. FIG. 10 illustrates an example in which the copper-based alloy paste includes Ni in an amount of 5 wt % of the copper-based alloy. FIG. 1D illustrates an example in which the copper-based alloy paste includes Ni in an amount of 7 wt % of the copper-based alloy.

In the examples in FIGS. 1B to 1D, the diameter of particles of the nickel (Ni) powder included in the copper-based alloy paste is 180 nm.

Referring FIGS. 1A to 1D, it can be inferred that the greater the weight percentage of nickel (Ni) is in the copper-based alloy included in the paste, the stronger the adhesive force is at the interface between the resist layer and the substrate. That is, referring to (FIG. 1A, it can be inferred that voids are present at the interface between the resist layer and the substrate, thereby lowering the adhesive force, but the voids at the interface are increasingly reduced from (FIG. 1B to FIG. 1D, thereby enhancing the adhesive force.

In an example in which the weight percentage of nickel (Ni) included in the paste exceeds 10 wt % of the copper based alloy, the sheet resistance itself is lowered, but the temperature coefficient of resistance (TCR) is increased.

In an example in which the diameter of particles of the nickel (Ni) powder is greater than or equal to 300 nm, the sinterability of the paste is lowered, thereby increasing the possibility of void formation at the interface between the resist layer and the substrate.

Chip Resistor

Figure 2:
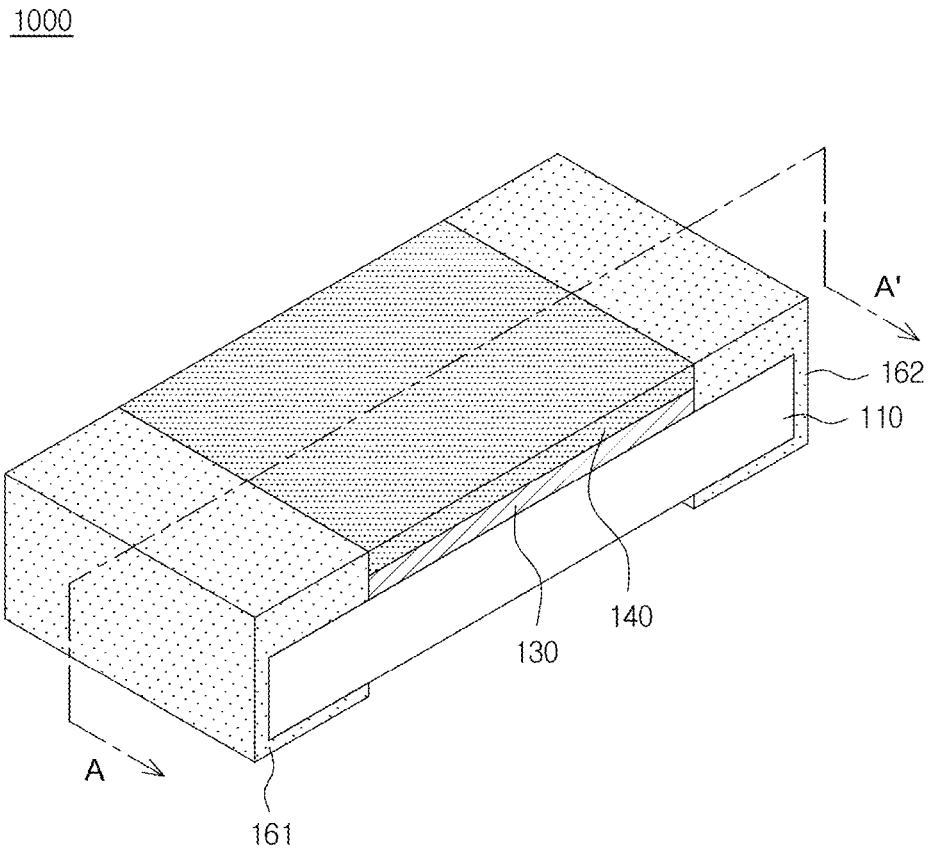
FIG. 2 is a brief illustration of a chip resistor, according to an embodiment.
Figure 3:
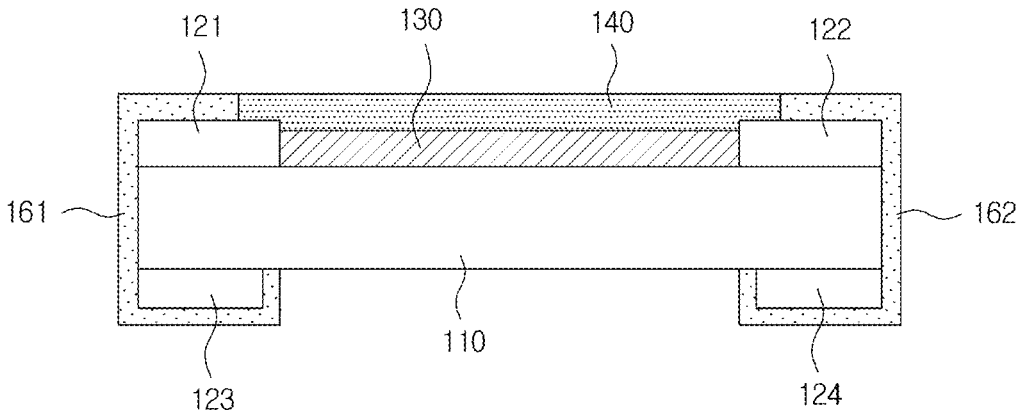
FIG. 3 shows a cross-sectional view along the line A-A' of FIG. 2.
Figure 4:
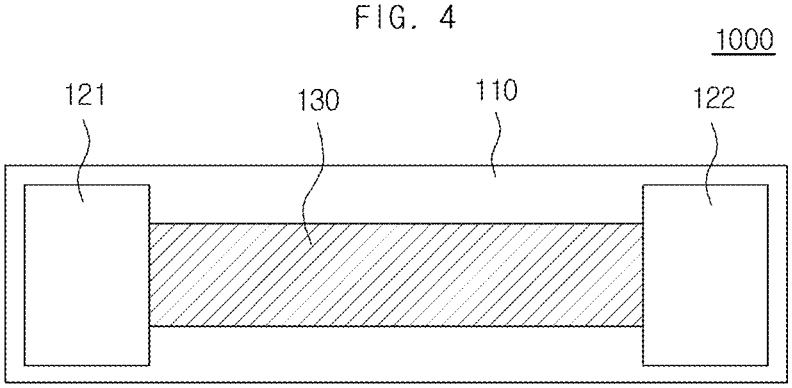
FIG. 4 and FIG. 5 are top views illustrating a resist layer, a first electrode and a second electrode that are applied to the chip resistor, according to an embodiment.
Figure 5:
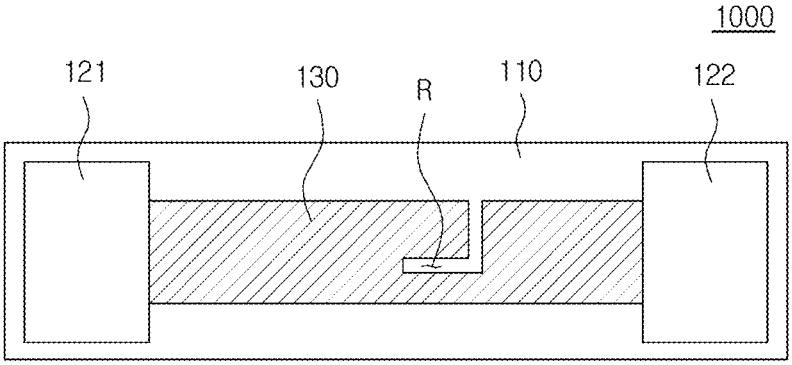

FIG. 2 is an illustration of a chip resistor 1000, according to embodiment. FIG. 3 shows a cross-sectional view along the line A-A' of FIG. 2. FIG. 4 and FIG. 5 are top views illustrating a resist layer 130, a first electrode 121, and a second electrode 122 that are applied to the chip resistor 1000, according to an embodiment.

Referring to FIGS. 2 to 5, the chip resistor 1000 includes a substrate 110, the first electrode 121, the second electrode 122, the resist layer 130, and a protective layer 140.

The substrate 110 provides space for mounting the first and second electrodes 121, 122 and the resist layer 130. For example, the substrate 110 is an electrically insulating substrate made of a ceramic material. The ceramic material may be alumina ($Al_2O_3$) but is not limited to any particular material as long as the material has good insulating and heat-dissipating properties and adheres well to the resist layer 130.

The first electrode 121 is disposed on one surface of the substrate 110. The second electrode 122 is disposed on the one surface of the substrate 110 in such a way that the second electrode 122 is separated from the first electrode 121. In other words, the first electrode 121 and the second electrode 122 are separated from each other and are each disposed on the one surface of the substrate 110.

The first electrode 121 and the second electrode 122 may be configured to have a low resistance value by including copper and/or copper alloy.

The resist layer 130 is disposed on the one surface of the substrate 110 to interconnect the first electrode 121 and the second electrode 122. In other words, the first electrode 121 and the second electrode 122 are electrically connected to each other by the resist layer 130.

The resist layer 130 includes a copper-based alloy and nickel (Ni) in an amount that is greater than 0 wt % and less than or equal to 10 wt % of the copper-based alloy. However, the resist layer 130 does not contain glass.

The copper-based alloy may include copper-manganese-tin (Cu—Mn—Sn). That is, the copper-based alloy may be Zeranin. Alternatively, the copper-based alloy may include copper-manganese-nickel (Cu—Mn—Ni). That is, the copper-based alloy may be Manganin.

In a conventional chip resistor, it is common that a paste for forming a primary resist layer containing glass and a paste for forming a secondary resist layer containing no glass are formed in order to provide a sufficient adhesive force between the substrate and the resist layer.

Specifically, since the copper-based alloy, which is the electrically conductive component of the paste, is very sensitive to the oxidizing atmosphere, it is preferable that the paste for forming the resist layer is handled under a strongest possible reducing atmosphere. Since glass, which is an inorganic adhesive, loses its fluidity when sintered in a reducing atmosphere, the paste for forming the primary resist layer and the paste for forming the secondary resist layer are commonly applied in parallel. As a result, the resist layer of a common chip resistor is formed to include the primary resist layer formed by the paste for forming the primary resist layer and the second resist layer formed by the paste for forming the secondary resist layer. Therefore, the overall thickness of the resist layer is increased, and the processes for forming the chip resistor become complicated.

With the resist layer 130 applied in the embodiment of FIGS. 2 to 5, it is possible to provide a sufficient adhesive force between the substrate 110 and the resist layer 130, even though the paste does not contain glass.

In an example in which an amount of nickel (Ni) included in the resist layer 130 exceeds 10 wt % of the copper-based alloy, the sheet resistance itself is lowered, but the temperature coefficient of resistance (TCR) is increased.

Referring to FIG. 5, the resistance value of the resist layer 130 may be fine-tuned by forming a groove R in the resist layer 130. That is, the resistance value of the resist layer 130 may be adjusted minutely through a trimming process.

The trimming process is, for example, a process of adjusting the resistance value of the resist layer 130 by, while forming the groove R in the resist layer 130 and simultaneously measuring the resistance value of the resist layer 130, and stopping the formation of the groove R when the resistance value approaches a target resistance value.

The groove R may be formed using laser, which may form the groove R from an edge to an inside portion of the resist layer 130. The longer the groove R is, the greater the resistance value of the resist layer 130 may be.

When the resistance value of the resist layer 130 becomes close to the target resistance value, the laser may change its direction of movement. For example, the groove may be formed in the shape of the letter "L" as shown in FIG. 5.

The increase in resistance value of the resist layer 130 caused by the increased length of the groove R after the direction of movement of the laser is changed may be slower than the increase in resistance value of the resist layer 130 caused by the increased length of the groove R before the direction of movement of the laser is changed. Therefore, the resistance value of the resist layer 130 may be adjusted much more precisely after the direction of movement of the laser is changed.

The protective layer 140 is disposed on one surface of the resist layer 130 so as to protect the resist layer 130.

The protective layer 140 may include, but is not limited to, epoxy, phenol resin, and glass. The protective layer 140 may protect the chip resistor 1000 from an outside environment.

As illustrated in FIG. 3, the protective layer 140 may be formed on the one surface of the resist layer 130 and may be extended partially onto the first electrode 121 and the second electrode 122, but the present disclosure is not limited to the configuration illustrated in FIG. 3. In an example in which the protective layer 140 is formed on the one surface of the resist layer 130 and extended partially onto the first electrode 121 and the second electrode 122, it is possible to enhance the adhesive force between the substrate 110 and the resist layer 130.

The chip resistor 1000 may further include a third electrode 123, a fourth electrode 124, a first metal cover 161, and a second metal cover 162.

The third electrode 123 and the fourth electrode 124 may, respectively, assist in the placement of the first electrode 121 and the second electrode 122. For example, the substrate 110 is fitted with the first metal cover 161 and the second metal cover 162, each in a U-shape, at either end of the substrate 110. The first metal cover 161 and the second metal cover 162 may press and stabilize the first electrode 121 and the second electrode 122, respectively. In such an example, the third electrode 123 and the fourth electrode 124 may be pre-formed on the opposite surface of the substrate 110 and pressed, respectively, by the first metal cover 161 and the second metal cover 162. As a result, the first electrode 121 and the second electrode 122 may be stabilized.

Moreover, since the overall area of the first, second, third, and fourth electrodes 121, 122, 123, 124 is increased by the third electrode 123 and the fourth electrode 124, the resistance values of the first electrode 121 and the second electrode 122 may be further decreased. As a result, the total resistance value of the chip resistor 1000 may be further lowered.

Figure 6:
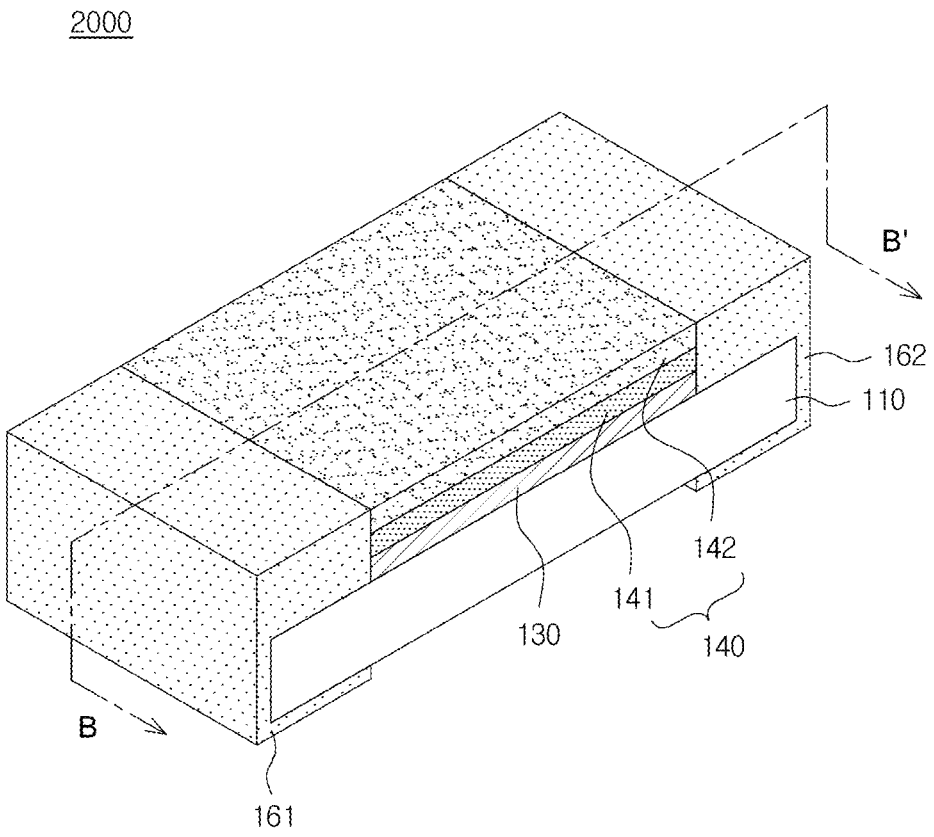
FIG. 6 is a brief illustration of a chip resistor, according to an embodiment.
Figure 7:
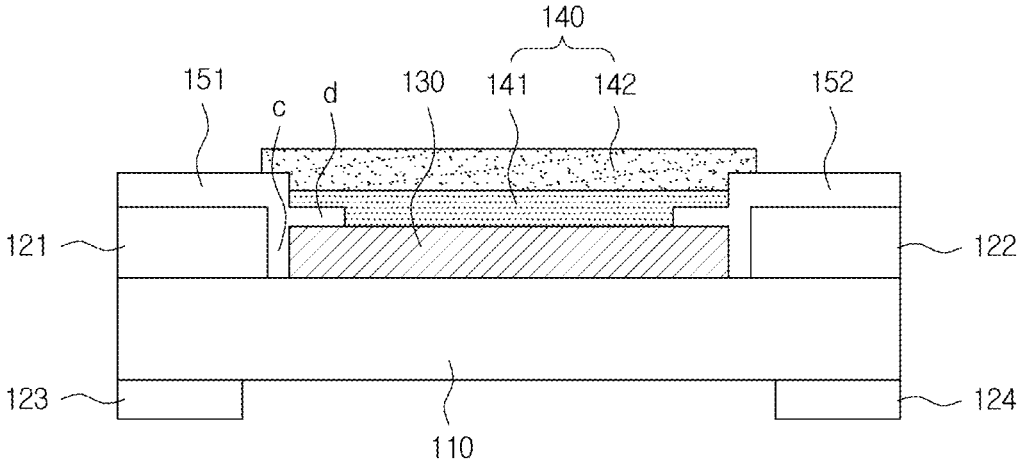
FIG. 7 shows a cross-sectional view along the line B-B' of FIG. 7.

FIG. 6 is an illustration of a chip resistor 2000 in accordance with another embodiment of the present disclosure. FIG. 7 shows a cross-sectional view along the line B-B' of FIG. 7. For convenience of description and understanding, the first metal cover 161 and the second metal cover 162, which are illustrated in FIG. 6, are not shown in FIG. 7.

Referring to FIG. 6 and FIG. 7, the chip resistor 2000 includes first and second upper surface electrodes 151, 152, and first and second protective layers 141, 142 that are different from the first and second upper surface electrodes 121, 122 and the protective layer 140 of the chip resistor 1000 in the embodiment of FIGS. 2 to 5. Accordingly, hereinafter, the first and second upper surface electrodes 151, 152 and the first and second protective layers 141, 142 will be mainly described.

First upper surface electrode 151 and second upper surface electrode 152 are formed, respectively, on first electrode 121 and second electrode 122. Specifically, the first upper surface electrode 151 is formed on the first electrode 121, and the second upper surface electrode 152 is formed on the second electrode 122.

The first upper surface electrode 151 and the second upper surface electrode 152 may perform a wiring function for transferring current between the first and second electrodes 121, 122 and an outside.

The first upper surface electrode 151 and the second upper surface electrode 152 each include an interpose part c, interposed between the first electrode 121 or the second electrode 122 and the resist layer 130, and an extension part d, extended from the interpose part c to at least a portion on one surface of the resist layer 130. For example, the first upper surface electrode 151 includes a first interpose part c, which is interposed between the first electrode 121 and the resist layer 130, and a first extension part d, which is extended from the first interpose part c to at least a portion on the one surface of the resist layer 130. Similarly, the second upper surface electrode 152 includes a second interpose part c, which is interposed between the second electrode 122 and the resist layer 130, and a second extension part d, which is extended from the second interpose part c to at least a portion on the one surface of the resist layer 130.

In such an example, since the first and second upper surface electrodes 151, 152 are formed, respectively, between the first and second electrodes 121, 122 and the resist layer 130 and are extended to at least portions of the one surface of the resist layer 130, it is possible to further enhance the bonding between the resist layer 130 and the substrate 110. Moreover, the first and second upper surface electrodes 151, 152 may efficiently dissipate heat generated by the resist layer 130 using the high thermal conductivity of metal.

The protective layer 140 includes a first protective layer 141, which is formed on the one surface of the resist layer 130 and on the extension part d, and a second protective layer 142, which is formed on the first protective layer 141.

The first protective layer 141 and the second protective layer 142 may each include, but are not limited to, epoxy, phenol resin and glass. The protective layer 140 may protect the chip resistor 2000 from an outside environment.

By forming the multiple protective layers and inserting the upper surface electrodes in the protective layers according to the disclosed embodiment, it is possible to enhance the bonding force between elements of the chip resistor 2000.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A paste for forming a resist layer of a resistor, comprising:

a copper-based alloy powder; and a nickel (Ni) powder in an amount greater than 0 wt % of the copper-based alloy powder and less than or equal to 10 wt % of the copper-based alloy powder, wherein the paste is glass-free.

2. The paste of claim 1, wherein the copper-based alloy powder comprises copper-manganese-tin (Cu—Mn—Sn).

3. The paste of claim 1, wherein a diameter of particles of the nickel (Ni) powder is less than or equal to 300 nm.

4. The paste of claim 1, wherein a diameter of particles of the nickel (Ni) powder is about 180 nm.

5. A chip resistor, comprising:

a substrate;

a first electrode disposed on a surface of the substrate;

a second electrode disposed on the surface of the substrate such that the second electrode is separated from the first electrode;

a resist layer disposed on the surface of the substrate so as to connect the first electrode and the second electrode to each other; and a protective layer disposed on a surface of the resist layer so as to protect the resist layer, wherein the resist layer comprises a copper-based alloy, and nickel (Ni) in an amount greater than 0 wt % of the copper-based alloy and less than or equal to 10 wt % of the copper-based alloy, and wherein the resist layer is glass-free.

6. The chip resistor of claim 5, wherein the copper-based alloy comprises copper-manganese-tin (Cu—Mn—Sn).

7. The chip resistor of claim 5, wherein the protective layer comprises a first protective layer disposed on the surface of the resist layer, and a second protective layer formed on a surface of the first protective layer.

8. The chip resistor of claim 5, wherein the resist layer comprises a groove.

9. The chip resistor of claim 5, wherein the groove is L-shaped.

10. The chip resistor of claim 5, further comprising upper surface electrodes formed, respectively, on the first electrode and the second electrode.

11. The chip resistor of claim 10, wherein the upper surface electrodes each comprise an interpose part interposed between the first electrode or the second electrode and the resist layer, and an extension part extended from the interpose part to a portion of the surface of the resist layer.

12. The chip resistor of claim 11, wherein the protective layer comprises a first protective layer formed on the surface of the resist layer and on the extension part, and a second protective layer formed on the first protective layer.

13. The chip resistor of claim 5, wherein the protective layer extends onto the first electrode and the second electrode.

14. A chip resistor, comprising:

a substrate;

a first electrode disposed on a surface of the substrate;

a second electrode disposed on the surface of the substrate such that the second electrode is separated from the first electrode;

upper surface electrodes respectively disposed directly on the first electrode and the second electrode;

a resist layer disposed on the surface of the substrate so as to connect the first electrode and the second electrode to each other; and a protective layer disposed on a surface of the resist layer so as to protect the resist layer, wherein the resist layer comprises a copper-based alloy and nickel (Ni), and wherein the resist layer is glass-free.

15. A chip resistor, comprising:

a substrate;

a first electrode disposed on a surface of the substrate;

a second electrode disposed on the surface of the substrate such that the second electrode is separated from the first electrode;

upper surface electrodes respectively disposed on the first electrode and the second electrode;

a resist layer disposed on the surface of the substrate so as to connect the first electrode and the second electrode to each other; and a protective layer disposed on a surface of the resist layer so as to protect the resist layer, wherein the upper surface electrodes each comprise an interpose part interposed between the first electrode or the second electrode and the resist layer, and an extension part extended from the interpose part to a portion of the surface of the resist layer, wherein the resist layer comprises a copper-based alloy and nickel (Ni), and wherein the resist layer is glass-free.

* * * * *